US011493036B2

(12) United States Patent
Morton et al.

(10) Patent No.: US 11,493,036 B2
(45) Date of Patent: Nov. 8, 2022

(54) SPOOL VALVE USED IN A VARIABLE VANE PUMP

(71) Applicant: Stackpole International Engineered Products, Ltd., Ancaster (CA)

(72) Inventors: Paul Morton, Mississauga (CA); Matthew Tyler Hughes, Erin (CA); Theresa Kam Lun Chan, Unionville (CA); Michael Benjamin Sy, Mississauga (CA)

(73) Assignee: Stackpole International Engineered Products, Ltd., Ancaster (CA)

( * ) Notice: Subject to any disclaimer, the term of this patent is extended or adjusted under 35 U.S.C. 154(b) by 199 days.

(21) Appl. No.: 16/877,693

(22) Filed: May 19, 2020

(65) Prior Publication Data

US 2020/0370551 A1 Nov. 26, 2020

Related U.S. Application Data

(60) Provisional application No. 62/850,074, filed on May 20, 2019.

(51) Int. Cl.

| | |
|---|---|
| ***F04C 2/344*** | (2006.01) |
| ***F04C 14/22*** | (2006.01) |
| ***F01M 1/16*** | (2006.01) |

(52) U.S. Cl.

CPC ..... *F04C 2/344* (2013.01); *F01M 1/16* (2013.01); *F04C 14/226* (2013.01)

(58) Field of Classification Search

CPC ..... F04C 2/344; F04C 14/226; F01M 1/16
See application file for complete search history.

(56) References Cited

U.S. PATENT DOCUMENTS

| | | | |
|---|---|---|---|
| 2,938,469 | A | 5/1960 | Lauck |
| 5,562,432 | A | 10/1996 | Semba et al. |
| 6,530,752 | B2 | 3/2003 | Oba et al. |
| 6,616,419 | B2 | 9/2003 | Watanabe et al. |

(Continued)

OTHER PUBLICATIONS

International Preliminary Report on Patentability dated Aug. 13, 2021, issued in corresponding International Application No. PCT/IB2020/054733 (22 pgs.).

(Continued)

*Primary Examiner* — Connor J Tremarche
(74) *Attorney, Agent, or Firm* — Pillsbury Winthrop Shaw Pittman, LLP

(57) ABSTRACT

A variable displacement vane pump is described. The pump includes a control chamber provided between a housing and a control slide. A pressure-controlled relief valve is in fluid communication with the outlet path and moves to block or unblock a relief port based on output pressure of the lubricant. A feedback channel fluidly connects the control chamber to an inlet path of the pump. The feedback channel further connects to a control port that is connected to a main control valve. The relief valve and control valve are distinct and not fluidly connected. The relief valve moves once the pressure in the outlet path exceeds a predetermined amount, opening the relief port, and thus delivers a portion of the output lubricant to the control chamber via the relief port, thereby pressurizing the control chamber and reducing eccentricity of the pump by displacing the control slide.

18 Claims, 10 Drawing Sheets

(56) References Cited

U.S. PATENT DOCUMENTS

| | | | | |
|---|---|---|---|---|
| 6,763,797 | B1 | 7/2004 | Staley et al. | |
| 8,047,822 | B2 | 11/2011 | Shulver et al. | |
| 8,057,201 | B2 | 11/2011 | Shulver et al. | |
| 8,444,395 | B2 | 5/2013 | Tanasuca et al. | |
| 8,496,445 | B2 | 7/2013 | Shulver et al. | |
| 8,602,748 | B2 | 12/2013 | Armenio et al. | |
| 9,017,049 | B2 | 4/2015 | Gasperin et al. | |
| 9,097,251 | B2 | 8/2015 | Maffeis | |
| 9,347,344 | B2 | 5/2016 | Watanabe et al. | |
| 9,410,514 | B2 | 8/2016 | Watanabe | |
| 9,534,519 | B2 | 1/2017 | Valkenberg | |
| 9,670,925 | B2 | 6/2017 | Watanabe et al. | |
| 9,714,657 | B2 | 7/2017 | Uchida et al. | |
| 10,030,656 | B2 | 7/2018 | Valkenberg | |
| 2007/0224067 | A1 | 9/2007 | Arnold et al. | |
| 2009/0196780 | A1 | 8/2009 | Shulver et al. | |
| 2009/0202375 | A1 | 8/2009 | Shulver et al. | |
| 2013/0136641 | A1 | 5/2013 | Novi et al. | |
| 2013/0251570 | A1 | 9/2013 | Tanasuca et al. | |
| 2016/0186623 | A1* | 6/2016 | Valkenberg ..... | F01M 1/02 418/26 |
| 2016/0186752 | A1 | 6/2016 | Valkenberg | |
| 2016/0363120 | A1 | 12/2016 | Meinig | |
| 2017/0234311 | A1 | 8/2017 | Watanabe et al. | |
| 2017/0314555 | A1 | 11/2017 | Imanaga | |
| 2017/0321696 | A1 | 11/2017 | Nagasaka et al. | |
| 2017/0328363 | A1 | 11/2017 | Morton | |

OTHER PUBLICATIONS

International Search Report and Written Opinion of the International Searching Authority dated Aug. 21, 2020 issued in corresponding International Application No. PCT/IB2020/054733 (14 pgs.).

* cited by examiner

SECTION A-A

SPOOL VALVE USED IN A VARIABLE VANE PUMP

CROSS-REFERENCE TO RELATED APPLICATIONS

This application claims priority to U.S. Provisional Application Ser. No. 62/850,074 filed May 20, 2019, the subject matter of which is incorporated herein by reference in entirety.

BACKGROUND

Field

The present disclosure is generally related to a variable displacement vane pump for providing pressurized lubricant to a system. More specifically, this disclosure relates to integrating a fail-safe function in the form of a pressure-controlled relief valve into a pump that is connected to the outlet volume and provides feedback to a control chamber in order to reduce eccentricity.

Description of Related Art

Vane pumps are known for use for pumping fluids or lubricants, such as oil, to internal combustion engines. Some known systems may utilize a single control chamber for moving lubricant. U.S. Pat. Nos. 8,602,748 and 9,097,251 and U.S. Patent Application No. 2013/0136641 illustrate examples of passively controlled variable vane pump having one control chamber, each of which is hereby incorporated in their entirety. Other types of pumps are disclosed in U.S. Pat. Nos. 8,047,822, 8,057,201, and 8,444,395, which are also incorporated by reference herein in their entirety.

U.S. Pat. Nos. 9,534,519 and 10,030,656, which are incorporated by reference herein in their entirety, describe examples of vane pumps that utilize electrical valves (e.g., PWM, or pulse width modulation, valve) in addition to a control valve. The '519 and '656 patents communicate via the electrical valve, controlling feed to/from the control chamber, and may implement a fail-safe function when the electrical valve is disabled or has failed. Further, the '519 and '656 patents block their vent port/channel for the control chamber before outlet pressure is applied to the control chamber.

SUMMARY

It is an aspect of this disclosure to provide a variable displacement vane pump for dispensing lubricant to a system. The pump includes: a housing having an inner surface defining an internal chamber; an inlet for inputting the lubricant into the housing for pressurization, the inlet being connected to an inlet path in the housing; and an outlet for delivering pressurized lubricant to the system from the housing, the outlet being connected to an outlet path provided in the housing. The pump also includes a control slide displaceable about a pivot pin within the internal chamber of the housing in (a) a displacement increasing direction for increasing pump displacement and (b) a displacement decreasing direction for reducing pump displacement, and the control slide having an inner surface defining a rotor receiving space; and a rotor with at least one vane mounted in the rotor receiving space of the control slide and configured for rotation within and relative to the control slide about a rotational axis for pressurizing the lubricant input via the inlet path, the at least one vane configured for engagement within the inner surface of the control slide during rotation thereof. The inlet and outlet are disposed on opposed radial sides of the rotational axis of the rotor. The inlet is provided on a first radial side and the outlet being provided on a second radial side that is opposite the first radial side. A resilient structure biases the control slide in the displacement increasing direction. The resilient structure is provided on the first radial side of the rotor and the pivot pin being provided on the second radial side of the rotor. The pump includes a control chamber for receiving pressurized fluid provided between the housing and the control slide that is configured and arranged to move the control slide in the displacement decreasing direction. The control chamber extends into both the first and second radial sides of the rotor. A relief port is provided in the housing for selectively communicating fluid from the outlet path to the control chamber. A feedback channel is provided in the housing and fluidly connects to a control port that is connected to a main control valve which is configured to control pressure in the control chamber. A pressure-controlled relief valve positioned in the housing, the relief valve having an activation surface being in fluid communication with the outlet path and being movable from a first valve position to a second valve position based on a predetermined pressure of the lubricant acting on the activation surface. The main control valve is configured to control pressure in the control chamber independently of the position of the relief valve, including delivering pressurized lubricant to pressurize the control chamber to displace the control slide in the displacement decreasing direction and venting pressurized lubricant from the control chamber to permit displacement of the control slide in the displacement increasing direction. In its first valve position, the relief valve is inactive and blocks fluid communication from the outlet path to the control chamber through the relief port. In its second valve position, the relief valve permits fluid communication of the lubricant from the outlet path to the control chamber through the relief port, thereby pressurizing the control chamber and displacing the control slide in the displacement decreasing direction independently from the main control valve.

Another aspect provides a system that includes the above noted variable vane pump, an engine, and a lubricant sump containing lubricant, the pump for dispensing lubricant to the engine.

Yet another aspect provides a method for reducing eccentricity of a variable vane pump like the pump noted above. The method includes: hydraulically moving the pressure-controlled relief valve from the first valve position to the second valve position based on the predetermined pressure of the lubricant acting on the activation surface; and permitting fluid communication of the lubricant from the outlet path to the control chamber through the relief port, thereby pressurizing the control chamber and displacing the control slide in the displacement decreasing direction independently from the main control valve. The main control valve is configured to control pressure in the control chamber independently of the position of the relief valve, including delivering pressurized lubricant to pressurize the control chamber to displace the control slide in the displacement decreasing direction and venting pressurized lubricant from the control chamber to permit displacement of the control slide in the displacement increasing direction.

Other features and advantages of the present invention will become apparent from the following detailed description, the accompanying drawings, and the appended claims.

DETAILED DESCRIPTION OF THE PREFERRED EMBODIMENT(S)

Figure 1:
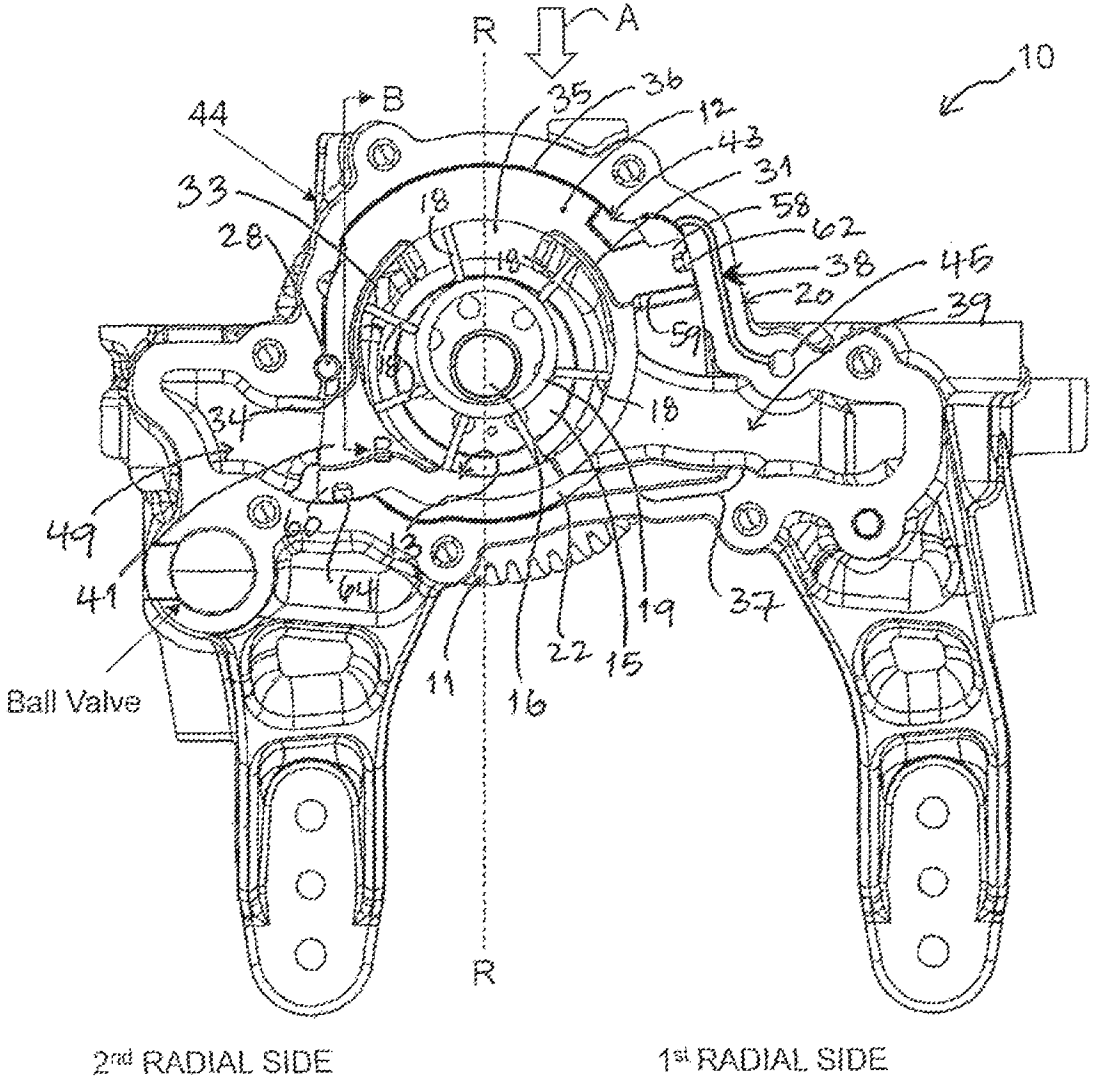
FIG. 1 is an overhead or top view of a pump and a housing in accordance with an embodiment of the present disclosure, with its cover removed, and the control slide in a first position.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments. Further, it is intended that embodiments of the disclosed subject matter cover modifications and variations thereof.

It is to be understood that terms such as "top," "bottom," "side," "upper," "lower," "interior," "exterior," "inner," "outer," and the like that may be used herein merely describe points of reference and do not necessarily limit embodiments of the present disclosure to any particular orientation or configuration. Furthermore, terms such as "first," "second," etc., merely identify one of a number of portions, components, steps, operations, functions, and/or points of reference as disclosed herein, and likewise do not necessarily limit embodiments of the present disclosure to any particular configuration or orientation, or any requirement that each number must be included.

As detailed herein, a variable displacement vane pump has a control slide displaceable within its housing and at least one control chamber in the housing for receiving pressurized lubricant. A vent path or feedback channel is also provided in the housing of the pump to feed or vent a portion of the lubricant to/from the control chamber to a main control valve. Further, a pressure-controlled valve (e.g., a spool valve, a relief valve, a directional control valve, a pilot valve, or, more simply, a control valve) is provided in the housing of the disclosed pump to act as a failsafe or safety feature for adjusting pump displacement. The pressure-controlled valve—referred to as a "relief valve" and/or "spool valve" throughout this disclosure—is a hydraulically operated valve that is movable from a first valve position to a second valve position based on a predetermined pressure of the pressurized lubricant delivered through the outlet. More specifically, the disclosed valve includes a sliding spool whose position relative to its casing or housing restricts or permits flow through a relief port in the pump housing, and thus may assist in controlling fluid flow within the pump. In an embodiment, the control valve is activated to its second valve position when pressure of pressurized lubricant is above a threshold level (e.g., at or above higher pressure than what is desired), thereby permitting fluid communication from the outlet path to a control chamber through a relief port. It may thus assist in pressurizing the control chamber of the pump and displace the control slide in a displacement decreasing direction, to thereby reduce eccentricity of the pump, independently of the main control valve.

As understood by one of ordinary skill in the art, "pump displacement" or "displacement" as used throughout this disclosure refers to a volume of liquid (lubricant) a pump is capable of moving during a specified period of time, i.e., a flow rate. In accordance with this disclosure, reference to lower or cold(er) temperatures of fluid/lubricant/oil is cold refers to fluid/lubricant/oil at cold start, e.g., when starting a pump and/or a system (e.g., engine) that is not running. The temperatures of the fluid/lubricant/oil at cold start may vary based on the type of fluid/lubricant/oil being utilized, atmospheric temperature, and/or the idle time of the pump/engine (including if the fluid/lubricant has completely drained from the pump/engine), for example. In some cases, as noted later, the temperature of the fluid/lubricant/oil at cold start may delay normal operation of the pump for a period of time. The features and devices in the herein disclosed pump may be utilized during cold start, in accordance with some embodiments.

Figure 2:
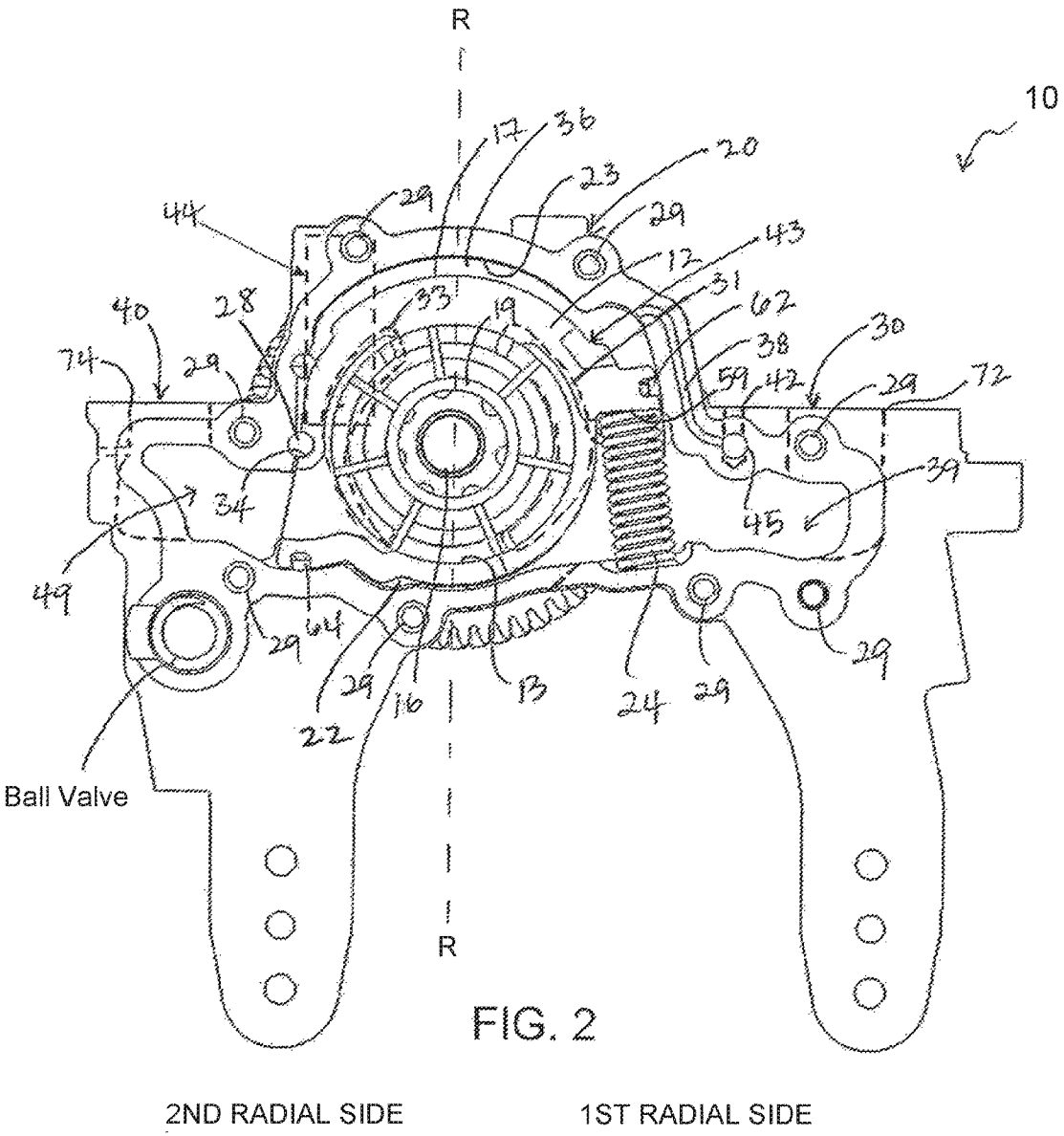
FIG. 2 is an alternate top view of the pump and housing of FIG. 1, with cover removed, and the control slide in a second position.

FIGS. 1 and 2 show top or overhead views of a pump 10, in accordance with an embodiment of the present disclosure, with its cover removed. The pump 10 is a variable displacement vane pump for dispensing fluid or lubricant to a system, in accordance with an embodiment. Pump 10 has a housing 20 with an inlet 30 and an outlet 40. The inlet 30 receives fluid or inputs lubricant to be pressurized or pumped (typically oil in the automotive context) from a source 26 (see FIG. 10) into the housing 20, such that the lubricant is pressurized therein, and the outlet 40 is used for discharging or delivering the pressurized fluid or lubricant to the system 32, e.g., engine or transmission (shown in FIG. 10), from the housing 20; and a lubricant sump 14 (shown in FIG. 10) for holding lubricant. A control slide 12 (explained in greater detail below), a rotor 15, a drive shaft 16, and resilient structure 24 (shown in FIG. 2, and removed from FIG. 1 simply to more clearly illustrate additional features of the pump) are provided in housing 20, as is generally known in the art. The pump shown in FIG. 1 has a control chamber 36 (further described below) between the housing 20 and the control slide 12 for receiving pressurized lubricant to move the control slide 12 from a displacement increasing direction. The resilient structure 24 biases the control slide 12 in one direction.

The inlet and outlet 30, 40 are disposed on opposing radial sides of the rotational axis of the rotor 15. As shown in FIGS. 1 and 2, for example, the inlet 30 is provided on a first radial side, or right side of these Figures, and the outlet 40 is provided on a second radial side, or left side of these Figures, that is opposite the first radial side. The dashed line R-R shown in these Figures represents a radial line that defines each radial side of the housing 20.

Figure 3:
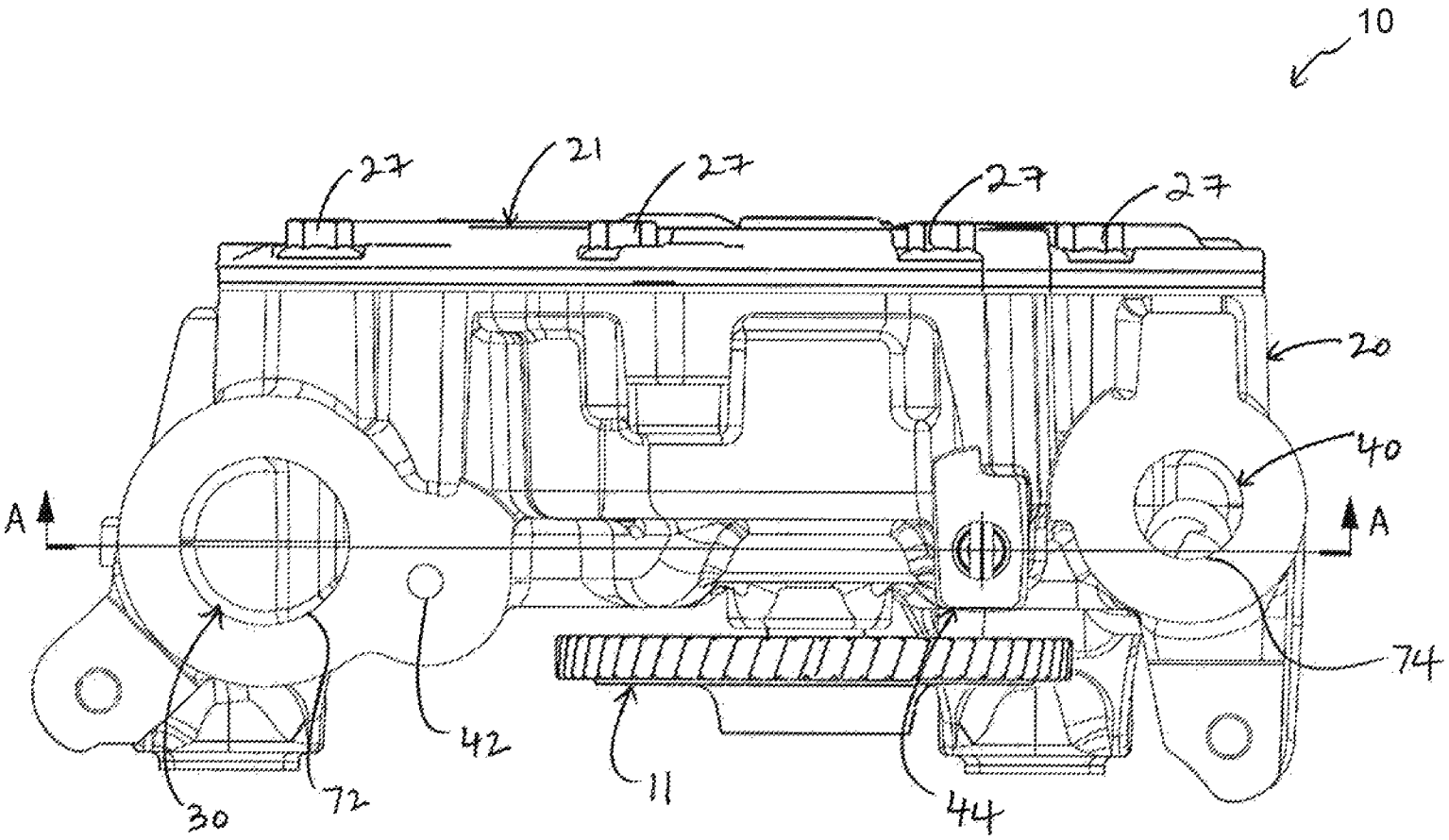
FIG. 3 is a side view of the pump and housing shown in FIGS. 1-2, including a cover and drive portion, in accordance with an embodiment.
Figure 4:
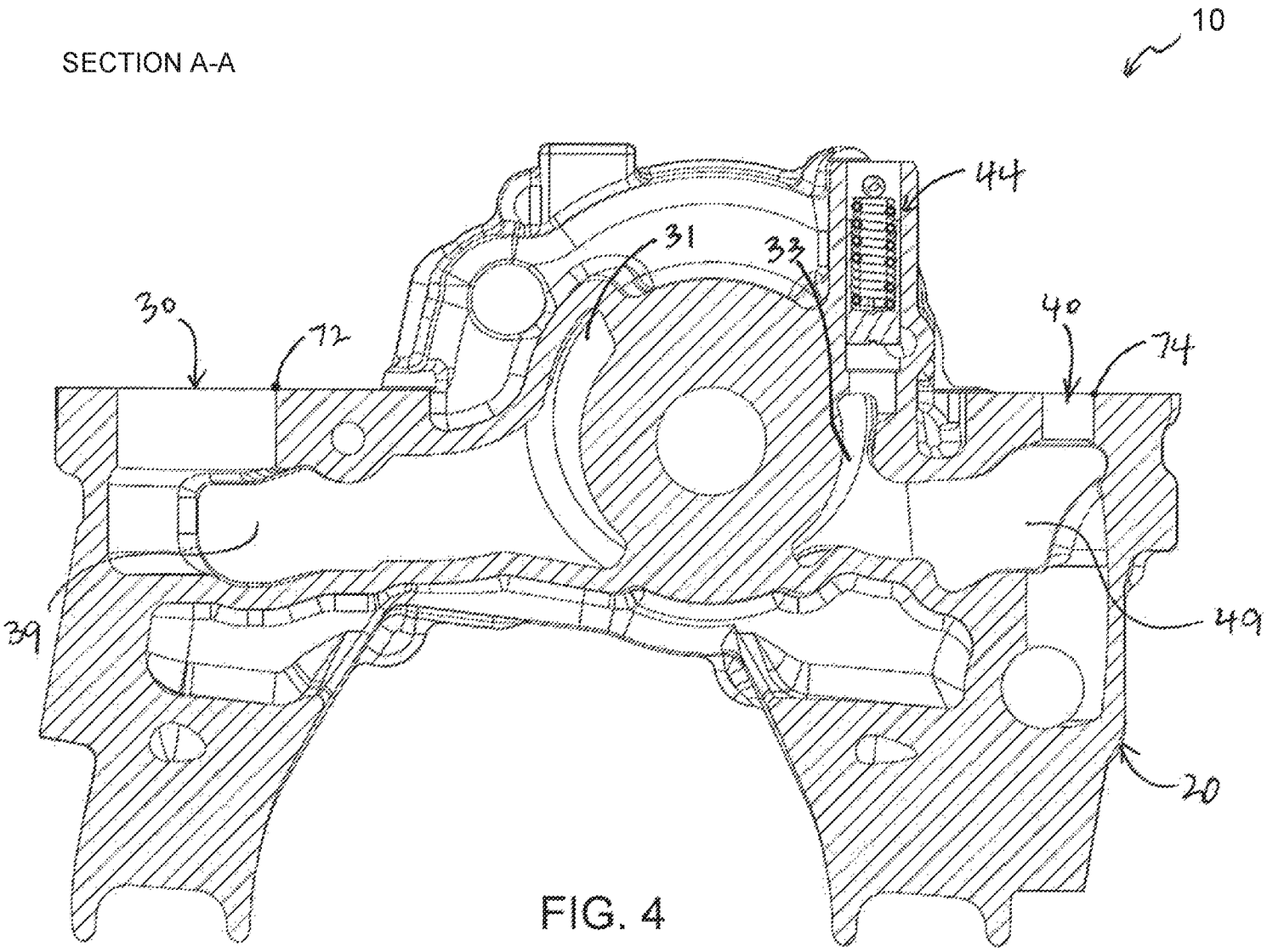
FIG. 4 is a cross-sectional view taken along line A-A of FIG. 3, showing a portion of an inlet and an outlet and a location of a relief valve within the housing of the pump.

The housing 20 has at least one inlet opening 72 that defines the inlet 30 for intaking fluid to be pumped, and at least one outlet opening 74 that defines the outlet 30 for discharging the fluid (see FIGS. 2-4). The housing 20 has also at least one inlet port 31 that defines the inlet 30 for intaking fluid to be pumped, and at least one outlet port 33 that defines the outlet 30 for discharging the fluid. The inlet port 31 and outlet port 33, each may have a crescent shape, and may be formed through the same wall located on one axial side or both axial sides of the housing (with regard to the rotational axis of the rotor 15). The inlet and outlet ports 31, 33 may also be disposed on opposing radial sides of the rotational axis of the rotor 15. These structures are conventional, and need not be described in detail. The shape of the inlet 30 and/or outlet 40 is also not intended to be limiting. Other configurations may be used, such as differently shaped or numbered ports, etc. Further, it should be understood that more than one inlet or outlet may be provided (e.g., via multiple ports).

As shown in FIGS. 1 and 2, the inlet 30 and inlet port 31 may be connected to an inlet path 39 (shown on the right radial side of these Figures) in the housing 20 and the outlet 30 and outlet port 33 may be connected to an outlet path 49 (shown on the left radial side of these Figures) provided in the housing 20. In an embodiment, the inlet path 39 is provided adjacent to the resilient structure 24 and the outlet path 49 is provided adjacent to a pivot pin 28 of the control slide 12. The inlet port 31 may form part of the inlet path 39 and the outlet port 33 may form part of the outlet path 49.

The housing 20 may be made of any material, and may be formed by aluminum die cast, iron sand cast, powdered metal forming, forging, or any other desired manufacturing technique. The housing 20 encloses an internal chamber, which includes a control chamber 36 (described later). In the drawings, the main shell of the housing 20 is shown. Walls define axial sides of the internal chamber and a peripheral wall 23 having an inner surface extends substantially around to define and surround the internal chamber peripherally. A cover 21 (e.g., partially shown in FIG. 3) attaches to the housing 20, such as by fasteners 27 (e.g., see FIG. 3 for a side view of some of the fasteners) (e.g., bolts) that are inserted into various fastener bores 29 (shown in FIGS. 1 and 3) placed along or around the housing 20 (e.g., around and outside a rotor receiving space 35). The cover is not shown in FIGS. 1 and 2, for example, so that some of the internal components of the pump can be seen. However, use of such cover is generally well known and need not be described in greater detail herethroughout. The cover may be made of any material, and may be formed by stamping (e.g., stamping steel or another metal), aluminum die casting, iron sand casting, powdered metal forming, forging, or any other desired manufacturing technique. The drawings also show parts of and an underside of the cover, which helps enclose the internal chamber of the pump 10 along with the housing 20. A gasket or other seal(s) may optionally be provided between the cover and peripheral wall of the housing 20 to seal the internal chamber. Additional fastener bores for receipt of fasteners may be provided along the peripheral wall of the pump 10, to secure or fix the pump 10 to an engine, for example.

The housing 20 and cover includes various surfaces for accommodating movement and sealing engagement of the control slide 12, which will be described in further detail below.

The control slide 12 (also known as a "control ring" in the art) is displaceable within the housing 20 and relative to the cover between at least a first slide position and a second slide position (or in between the two positions, and, in some cases, a third slide position), to adjust displacement of the pump 10 and thus flow through the outlet 40 (e.g., as fed through the outlet port 33). In accordance with an embodiment, the control slide 12 is pivotally mounted and configured for pivotal displacement within the housing 20 between the first and second slide positions. For example, the control slide 12 can be pivotally mounted relative to the internal chamber. When the control slide 12 is displaced away from the first slide position, the control slide 12 can be considered to be in a second slide position, despite the angle of pivoting or rotation. In an embodiment, the control slide 12 is displaceable within the internal chamber of the housing in a displacement increasing direction for increasing pump displacement (i.e., a first slide position) and a displacement decreasing direction for reducing pump displacement (i.e., a second slide position). In one embodiment, the first slide position is defined as a home position, which may provide maximum displacement by the pump, i.e., a position or direction that increases eccentricity between the control slide 12 and rotor axes, such as represented in FIG. 1. As the eccentricity increases, the flow rate or displacement of the pump increases. Conversely, as the eccentricity decreases, and the control slide 12 pivots away from the first position to a second/displacement decreasing position, so the flow rate or displacement of the pump also drops or decreases. Accordingly, the second slide position is different than the first slide position and may be defined as a position away from the first slide position (or away from a position for maximum displacement), e.g., a reduced displacement position, such as shown in FIG. 2. More specifically, in an embodiment, the second slide position may include any number of positions that is away from the first slide position, and may, in one embodiment, include when the slide is close to a minimum displacement position, or may be the minimum displacement position. In some embodiments, there may be a position where the eccentricity is zero, meaning the rotor and ring axes are coaxial. In this position, the flow is zero, or very close to zero, because the high and low pressure sides have the same relative volumes. Again, this functionality of a vane pump is well known, and need not be described in further detail.

In an embodiment wherein the control slide 12 pivots, a pivot pin 28 or similar pivoting or rotation feature may be provided for the pivoting action of the control slide 12, such that the control slide 12 is pivotally or rotationally displaceable about the pivot pin 28 within the internal chamber of the housing 20 between slide positions, as described above. The pivot pin 28 can be mounted to the housing 20. In one embodiment, as shown, the pivot pin 28 is mounted to the housing 20 within the chamber, and the control slide 12 has a concave, semi-circular bearing surface 34 that rides against the pivot pin 28. In some embodiments, the pivot pin 28 may extend through a bore in the control slide 12, rather than within a concave external bearing recess. The configuration of the pivotal connection of the control slide 12 in the housing 20 may have other configurations, and thus these examples should not be considered limiting. In an embodiment, the pivot pin 28 may be mounted in the housing 20 in a position that is adjacent to the outlet 40. In an embodiment, the pivot pin 28 may be provided in the housing 20 on an opposite side of the inlet 30. In one embodiment, the pivot pin 28 may be provided on the second radial side of the rotor 15. Additional details regarding the placement of the pivot pin 28 in the housing 20 described throughout this disclosure.

The pump 10 also has a rotor receiving space 35 (or pocket). The rotor receiving space 35 may have a configuration or shape that compliments the design, configuration, or shape of drive shaft 16 and rotor 15, such that it connects with the drive shaft 16 that drives the rotor 15 of the pump. This rotor receiving space 35 communicates directly with the inlet and outlet for drawing in oil, lubricant, or another fluid under negative intake pressure through the inlet 30, and expelling the same under positive discharge pressure out the outlet 40. In an embodiment, the rotor receiving space 35 is defined by an inner surface 13 of the control slide 12.

The rotor 15 is rotatably mounted in the housing 20 within the rotor receiving space 35/inner surface 13 of the control slide 12. The rotor 15 is configured for rotation within and relative to the control slide 12 about a rotational axis for pressuring fluid/lubricant that is input via the inlet path 39 through inlet 30. The rotor 15 has a central axis that is typically eccentric to a central axis of the control slide 12. The rotor 15 is connected to a drive input in a conventional manner, such as via a drive pulley, drive shaft, engine crank, or gear 11 (with drive shaft 16), which is shown in FIG. 3.

The rotor 15 has at least one radially extending vane 18 mounted to the rotor 15, for radial movement, and a vane ring 19. In the illustrated embodiment, multiple vanes 18 are shown. The at least one vane 18 is configured for engagement with an inside/inner surface 13 of the control slide 12 during rotation thereof. Specifically, each vane 18 is mounted at a proximal end in a radial slot in the central ring of the rotor 15 in a manner that allows them to slide radially. Centrifugal force may force the vane(s) 18 radially outwardly to engage and/or maintain engagement between distal end(s) of the vane(s) and an inside or inner surface 13 of the control slide 12 during rotation thereof. This type of mounting is conventional and well known. Other variations may be used, such as springs or other resilient structures in the slots for biasing the vanes radially outwardly, and this example is not limiting. Thus, the vane(s) 18 can be sealingly engaged with the inner surface 13 of the control slide 12 e.g., by the vane ring 19, such that rotating the rotor 15 draws fluid in through the inlet 30 by negative intake pressure and outputs the fluid out through the outlet 40 by positive discharge pressure. The control slide 12 can be moved (e.g., pivoted) to alter the position and motion of rotor 15 and its vane(s) 18 relative to the inner surface 13 of the slide 12, and, thus, alter the displacement of the pump and distribution of lubricant through the outlet 40.

Because of the eccentric relationship between the control slide 12 and the rotor 15, a high pressure volume of the fluid is created on the side where the outlet 40 is located, and a low pressure volume of the fluid is created on the side where the inlet 30 is located (which in the art are referred to as the high pressure and low pressure sides of the pump). Hence, this causes the intake of the fluid through the inlet 30 and the discharge of the fluid through the outlet 40. This functionality of the pump is well known, and need not be detailed further.

Typically, the resilient structure 24 may bias or urge the control slide 12 in or towards its displacement increasing direction, or first slide position. In the illustrated embodiment, the resilient structure 24 is a spring, such as a coil spring. In accordance with an embodiment, the resilient structure 24 is a biasing member for biasing and/or returning the control slide 12 to its default or biased position (i.e., in a displacement increasing direction, or first or home slide position, e.g., for maximum eccentricity with the rotor 15). In an embodiment, the resilient structure 24 may be provided on a first side of the control slide 12 and the pivot pin 28 may be provided on a second side of the control slide such that it is opposite to that of the resilient structure 24. In one embodiment, the resilient structure 24 may be provided on the first radial side of the rotor 15 and the pivot pin 28 may be provided on the second radial side of the rotor 15 (see, e.g., FIG. 2).

The housing 20 may include a receiving portion 37 or cut-out for the resilient structure 24, partially shown in FIG. 2, for example. The receiving portion 37 may be defined in part of the peripheral wall 23, for example, to locate and support the structure (or spring). The receiving portion 37 may include a bearing surface against which one end of the spring is engaged. The control slide 12 may include a radially extending projection or bearing structure 58 defining a bearing surface 59 against which the resilient structure 24 is engaged, for example. Other constructions or configurations may be used.

The control slide 12 may include a second radially extending projection 60 on a relatively opposite side to the first radially extending projection/structure 58; i.e., the projection 60 may be on the second radial side of the rotor, for example. Seals 62 and 64 may optionally be attached to the projections 58 and 60 (respectively), in accordance with an embodiment. More specifically, in an embodiment, seals 62 and 64 may be provided between the inner surface (i.e., peripheral wall 23) of the internal chamber of the housing 20 and an outer surface 17 of the control slide 12. In an embodiment, a first seal 62 may be provided adjacent to the resilient structure 24 and a second seal 64 may be provided adjacent to the pivot pin 28. In one embodiment, the first seal 62 is provided on the first radial side of the rotor 15 and the second seal 64 is provided on the second radial side of the rotor 15. The seals 62, 64 may define the chamber(s) 22, 36 within the internal chamber of the housing 20, for example.

FIGS. 1-2 show a first (inlet) chamber 22 between the housing 20 and the control slide 12 and a second control chamber 36 between the housing 20 and the control slide 12 for receiving pressurized lubricant (e.g., from a pressurized source, such as the outlet path) in the pump 10. As seen in FIG. 1, for example, a circumferential portion of the control chamber 36 is provided in the housing such that it extends on one side of the slide 12, while a circumferential portion of chamber 22 is provided in the housing such that it extends on the other, opposite/second side of the slide 12. Chamber 22 is connected to and part of inlet path 39. The first chamber 22 and the second control chamber 36 each has at least one port for receiving pressurized fluid. For example, the least one port associated with the control chamber 36 may be communicated with the outlet 40 of the housing 20 for receiving the pressurized fluid under the positive discharge pressure. The pressurized fluid may be received from other sources of positive pressure as well, such as the engine oil gallery, piston squirters, etc., and diversion of the discharge pressure is not intended to be limiting.

The first chamber 22 is controlled via the second control chamber 36 and the control slide 12, i.e., based on the position of the control slide 12 and the amount of pressurized fluid being fed to the control chamber 36. As shown in FIG. 1, when the pressurized fluid being fed to control chamber 36 is limited, the first chamber 22 may move or force—along with the resilient structure 24—the control slide 12 into its displacement increasing direction. The slide 12 may be moved to the displacement increasing direction based on the pressure of the lubricant being fed through inlet 30 via inlet port 31.

The second control chamber 36 is controlled in a traditional manner using passive control, e.g., it is outlet pressure controlled or gallery pressure controlled by pressure feedback. That is, a positive pressure of force from the pressurized lubricant can be applied to the second control chamber 36, and thus applied to control slide 12, to force the slide 12 into its displacement decreasing direction (i.e., second slide position) where eccentricity is decreased, such as shown in FIG. 2. For this reason, then, second control chamber 36 may be also referred to as a pressure regulating or feedback control chamber 36 that receives pressurized fluid and that is configured and arranged to move the control slide 12 in the displacement decreasing direction. In an embodiment, any pressure change in control chamber 36 may result in the control slide 12 moving or pivoting (e.g., centering) relative to the rotor 15, in order to adjust (reduce or increase) displacement in the pump.

At least the first seal 62 may define the pressure regulating chamber, or control chamber 36, for receiving pressurized fluid. In accordance with an embodiment, the feedback control chamber 36 is defined as a chamber between the outside shape/surface 17 of the slide 12 and the internal chamber of the pump housing 20, extending between the pivot pin 28 and first seal 62 in a clockwise direction of the slide 12. As shown, the feedback control chamber 36 extends into both the first and second radial sides of the rotor 15. The second seal 64 may be provided on a side of the control slide that is opposite to the feedback control chamber 36. The first chamber 22 may be defined between first seal 62 and second seal 64, in the clockwise direction. The first chamber 22 also extends into both the first and second radial sides of the rotor 15.

The shape of the projections 58, 60 of the control slide 12 is not intended to be limiting. In one embodiment, one or both of the projections may include two converging surfaces (e.g., see projection 60, shown in FIG. 1). In an embodiment, one or both of the projections may include two parallel bearing surfaces (e.g., see projection 58 in FIG. 1). These projections 58, 60 may have any other construction or configuration. In the illustrated embodiment, the projections 58, 60 each include a cut-out portion for receiving the seals 62, 64 and any corresponding structures therein. The seals 62, 64 may be positioned at an outside end of the cut-out portions for contact with the inner wall(s) such that the seals 62, 64 may slide along the surface of the inner wall(s) of the housing 20 as the control slide 12 moves or pivots therein. In an alternate embodiment, the housing's peripheral wall 23 may include recessed areas in which the structures carrying the seals 62, 64 are located. Those recessed areas may be configured based on the travel of the ring to enable the seals 62, 64 to maintain contact therewith throughout the range of movement for the control slide 12 and ensure the sealing. The specific geometry illustrated is not intended to be limiting, and may vary depending on the specific location of the seals, the amount of travel permitted for the ring, the overall packaging of the pump 10, etc. In an embodiment, any number of seals may be provided between the housing 20/cover 21 and the control slide 12, for example. In the illustrated embodiment, the seal 62 is about 170 degrees from the pivot pin 28, but it could be more or less depending on various factors, such as (but not limited to) packaging constraints, desired pressure range, etc. For example, the seal 62 could be located at anywhere between approximately 50 degrees to approximately 180 degrees (both inclusive). The position of seal 62 is determined, in accordance with an embodiment, by the area needed to develop force against spring/resilient structure 24 with the desired regulating pressure. Seal 64 is positioned, in accordance with an embodiment, as close as possible to the pivot pin 28 while providing enough cross sectional area for the lubricant/oil to pass over and under the slide 12 to channel 49, without excessive restriction. In the illustrated embodiment, the seal 64 is provided adjacent to the outlet path 49, so as to stop any flow of lubricant between the outlet path 49 and chamber 22 and/or inlet path 39, for example.

As shown in FIGS. 1 and 2, for example, the outlet path 49 may have a first side and a second side, and wherein the pivot pin 28 may be provided in the housing 20 on or adjacent to the first side of the outlet path 49 and the second seal 64 may be provided in the housing 20 on or adjacent to the second side of the outlet path 49. The control slide 12 may optionally include an outflow passage 41 formed therein that has a first side edge and a second side edge that aligns with sides of the outflow path 49. Accordingly, in an embodiment, the pivot pin 28 may be provided in the control slide 12 (e.g., against bearing surface 34) on the first side of the outflow passage 41, and the second seal 64 may be placed in a cut-out portion of the slide 12 adjacent the second side of the outflow passage 41. The outflow passage 41 may be formed (e.g., molded) on a top of the control slide such that it allows flow of lubricant under the slide 12 as well as through the passage 41 and thus between a top portion of the slide 12 and an inside, slide-facing side of cover 21. In accordance with an embodiment, a depth of the outflow passage 41 (relative to a top surface of the control slide 12) may be approximately 3 mm to 4 mm (both inclusive). The depth is limited by the required amount of contact area required between the rotating vanes 18 and the inside surface 13 of the slide 12.

The control slide 12 may further include a fluid receiving surface 43 therein, for receiving and filling with pressurized fluid from a portion of the control chamber 36. In an embodiment, the fluid receiving surface 43 may be provided on the first radial slide of the rotor 15, e.g., near the spring or resilient structure 24, adjacent the first radially extending projection 58 of the control slide 12. This receiving area allows the lubricant/oil to pass around the slide contact area with the housing 20 when the slide 12 is in its most eccentric position. As further explained later, filling this fluid receiving surface 43 enables fluid to saturate a feedback channel 38 that is connected to a main control valve 70 for controlling the pump 10.

In accordance with an embodiment, the positions of the control slide 12 in pump 10 are controlled by a main control valve 70 (schematically represented in FIG. 10), which is configured and arranged to control the pressure in the control chamber 36 behind the slide 12 and, as a consequence, influence the slide position and the pump displacement. The main control valve may also be referred to as an "electrical valve." Although "electrical valve" is a term used throughout this disclosure, it should be understood that an electrical valve as noted herein is defined as a regulating valve that may be energized and controlled by an electrical signal, e.g., an electric current. It should be understood that an "electrical valve" in this disclosure may also be an electro-mechanical valve. In one embodiment, the valve 70 is an electromagnetic valve that is switched between states using an external controller, such as a pulse width modulation (PWM) valve. In another embodiment, the valve 70 is a variable current valve. In yet another embodiment, the valve 70 is a solenoid valve. Accordingly, the type of electrical or control valve 70 used in the pump 10 is not intended to be limiting. Generally, use of such a main control or electrical (PWM) valve 70 with pumps is generally known in the art, and thus, other than some further features described later, its function is generally understood by one of skill in the art.

The electrical valve 70 is connected to a control port 42 provided in the housing 20. FIG. 3 shows a side view of the housing 20 illustrating an exemplary location of the control port 42, i.e., adjacent to the inlet port 30. Port 42 is an input control port (e.g., from engine block and/or from PWM/main control valve 70) that is in fluid communication with port or passage 45. Port 42 may be drilled, formed, or machined into the housing. Passage 45 is a drilled path or channel that is drilled, formed, or machined into the pump housing. Holes or ports 42, 45 are added/designated for communication with a feedback channel. Specifically, as illustrated in the Figures, connected to the control port 42, through the drilled passage 45, is a feedback channel 38 (i.e., control port 42 connects to feedback channel through hole/passage 45). The feedback channel 38 is formed in the housing 20 in order to provide a path for fluid/lubricant to flow from the electrical valve 70 and to the feedback control chamber 36. By fluidly connecting the electrical valve 70 with the control chamber 36 through control port 42 (and 45) and to the feedback channel 38, pressure (and amount of lubricant) in the control chamber 36 may be controlled.

Feedback channel 38 may also be referred to as a vent channel, for venting fluid. In some cases, venting is based on a position of the electrical valve 70. In an embodiment, when the control slide 12 needs to increase displacement, the control valve is configured to vent [fluid/lubricant from] control chamber 36 through the feedback channel 38, passage 45, and control port 42, through the electrical valve (or another control valve), so that fluid/lubricant makes its way back to the sump (e.g., sump 14 or tank).

The feedback channel 38 and port 42/45 remains open to the electrical control (PWM) valve 70 during all conditions and states, including during cold start. However, flow through the channel 38 may be limited based upon pump conditions. During regular functioning and use of the pump 10, for example, feedback channel 38 receives sufficient (warm) lubricant/oil/fluid from the main control valve 70. In this case, for example, "sufficient" refers to a regular flow rate of lubricant through the channel 38. During cold start, for example, the size and dimension of the system feedback channel to main control valve 70, and from control valve to port 42, restricts or limits movement of cold lubricant therethrough, delaying pressure response to the feedback channel 38, and thus control chamber 36. This allows pressure to build within outlet channel 49, and upstream to the system. As described in greater detail below with reference to the high pressure relief valve 44, once pressure builds in the outlet, feedback to the control chamber 36 is affected, including control of the control slide 12, even when lubricant is cold.

In accordance with an embodiment, the feedback channel 38 is designed to be narrow such that it is restrictive with regards to flow of cold lubricant therein for a period of time, but still allows cold lubricant to flow through during a cold start. This restriction promotes pressure to build up quickly in chamber 36 when relief valve 44 is activated (which is also described in greater detail below). However, the feedback channel 38 is not restrictive with regulated flow levels from control valve 70. Communication of lubricant to/from the control chamber 36 via the feedback channel 38 may be allowed during fail safe conditions as well as during normal operation of the pump.

In an embodiment, the feedback channel 38 is newly added to a pump housing. That is, the vent channel may be added to (e.g., machined in) an existing pump housing. The location of the feedback channel 38 is not intended to be limiting. In one embodiment, the feedback channel 38 is positioned adjacent to the resilient structure 24. In an embodiment, the feedback channel 38 is positioned adjacent the first seal 62. In an embodiment, the feedback channel 38 is positioned adjacent the inlet 30. In another embodiment, the feedback channel is provided on a first radial side of the rotor 15. In yet another embodiment, the feedback channel is provided between the housing and a cover. In still yet another embodiment, the feedback channel is formed in a wall that defines the internal chamber of the housing. Such embodiments are not intended to be limiting. In fact, a combination of these embodiments may be implemented in the pump 10. For example, as shown in FIG. 2, in accordance with one embodiment, the feedback channel 38 may be designed to be positioned on a first radial side of the rotor 15, adjacent to the resilient structure 24, first seal 62, and inlet 30, and between the housing 20 and cover. Further, the illustrated embodiment in not intended to limit the location of the feedback channel 38. In some embodiments, for example, the feedback channel 38 may be connected to a center portion (e.g., along line R-R) of the control chamber 36, and/or provided adjacent the pivot pin 28, for example. Despite its location in the housing 20, feedback channel 38 is designed to allow pressurizing and venting via electrical valve 70.

The pump 10 may also include a high pressure relief valve 44 (e.g., controlled by outlet pressure in passage 49) provided in the housing 20, along with the connected electrical (PWM) valve 70. As previously noted, the disclosed relief valve 44 may be a spool valve, for example. The valves 44 and 70 are separate and not fluidly connected. However, relief valve 44 may also provide feedback and control of the pump 10. For example, the relief valve 44 may provide pressure relief when pressure is too high in the outlet to reduce eccentricity and thus flow in the pump.

FIGS. 1 and 2 illustrate an example of a location for the relief valve 44 (and its housing) in the housing 20. In an embodiment, the relief valve 44 (and its housing) is positioned in the housing 20 on the second radial side of the rotor 15. In an embodiment, the relief valve 44 is positioned near or adjacent to the pivot pin 28 of the control slide 12 of the pump 10. In one embodiment, the pressure-controlled relief valve 44 is positioned within the housing 20 and below the pivot pin 28. Generally, the relief valve 44 is designed to be connected to the outlet volume through outlet path 49 and to the feedback control chamber 36 of the pump 10. Accordingly, as shown in FIG. 3 and seen in the cross-sectional view of FIG. 4, the relief valve 44 may be positioned adjacent the outlet port 33 in the housing 20, in accordance with an embodiment.

Figure 5:
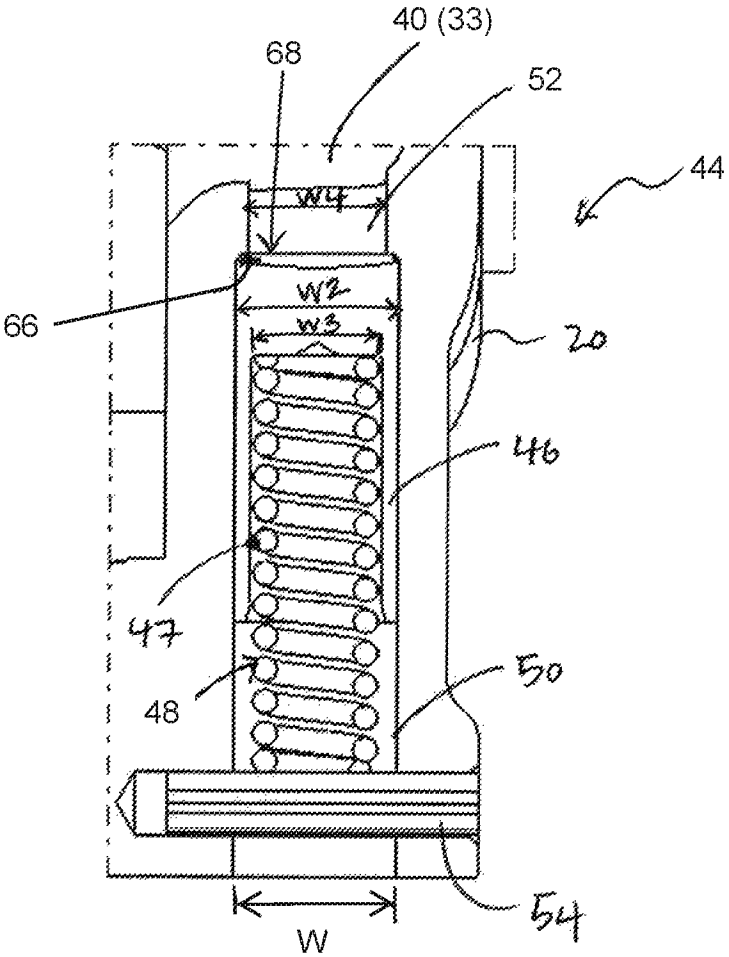
FIG. 5 is an alternate cross-sectional view of the relief valve of the pump, showing further details of the relief valve.

FIG. 5 is an alternate cross-sectional view of the relief valve 44, showing further exemplary details thereof. In accordance with an embodiment, the relief valve 44 has a spool body 46 with an activation surface 68 that is in fluid communication with the outlet path 49. In an embodiment, the activation surface 68 may be a front surface of the body 46. Generally, the relief valve 44 is configured and arranged to be movable from a first valve position (or home or default position, shown in FIGS. 6-7) to a second valve position (i.e., a position away from the first valve position, shown in FIGS. 8-9) based on a predetermined pressure (threshold pressure) of the lubricant acting on the activation surface 68 of the body 46, including exceeding the predetermined amount.

In accordance with an embodiment, the pressure-controlled relief valve 44 includes a spring 48 for biasing the body 46 into the first valve position. The spring 48 may be provided within a receiving opening 47 of the body 46, such as shown in FIG. 5. The spring 48 is configured to apply spring force to the body 46 to direct it to a first valve position, i.e., towards wall abutment 66 (see also FIG. 6), towards a closed or inactive position (further detailed below). In an embodiment, the disclosed pressure-controlled valve 44 fits into a machine formed valve space 50. That is, in an embodiment, the valve space 50 (or valve housing) may be molded, formed, drilled, or machined into the pump housing 20 such that the valve space 50 is formed integrally as part of the pump. Accordingly, parts of the valve 44 (e.g., spool body 46 and spring 48), may be placed into the pump housing in the designated area. In an embodiment, a pin 54 may be provided in the valve space 50 in order to secure and hold ends of the body 46 and spring 48 within the housing and space 50. In the illustrated embodiment, for example, the pin 54 is placed perpendicular to a longitudinal extent of the body 46, at one end thereof, while the other end—i.e., the activation surface 68—is provided in fluid communication with the outlet path 49. In another embodiment, a housing may be designed to contain parts of the valve 44 therein, such that the housing may be inserted into a designated area (e.g., space 50) the pump 10.

In addition to providing a valve space 50 or housing for relief valve 44 in the housing 20, a supply control volume 52 is also provided. The supply control volume 52 connects at least part of the outlet path 49 (e.g., part of outlet port 33) to the valve space 50 of the pressure-controlled relief valve 44, and is configured to receive output pressurized lubricant therein. As described in detail below, pressure of the lubricant is configured to build in the supply control volume 52 such that upon reaching and/or exceeding a predetermined output pressure or threshold, the relief valve 44 may be moved away from its first valve position, and to a second valve position. More specifically, pressure may be applied to the activation surface 68 of the body 46 as a result of the lubricant from the outlet path 49 being fed through the supply control volume 52 and, as a resulting of building up, apply force to the activation surface 68 to move the body 46 of the pressure-controlled relief valve 44 and compress the spring 48. The aforementioned wall abutment 66 limits movement of the body 46 within the housing 20 and into the supply control volume 52 when pressure in the supply control volume is lower or less than the predetermined output pressure.

Figure 6:
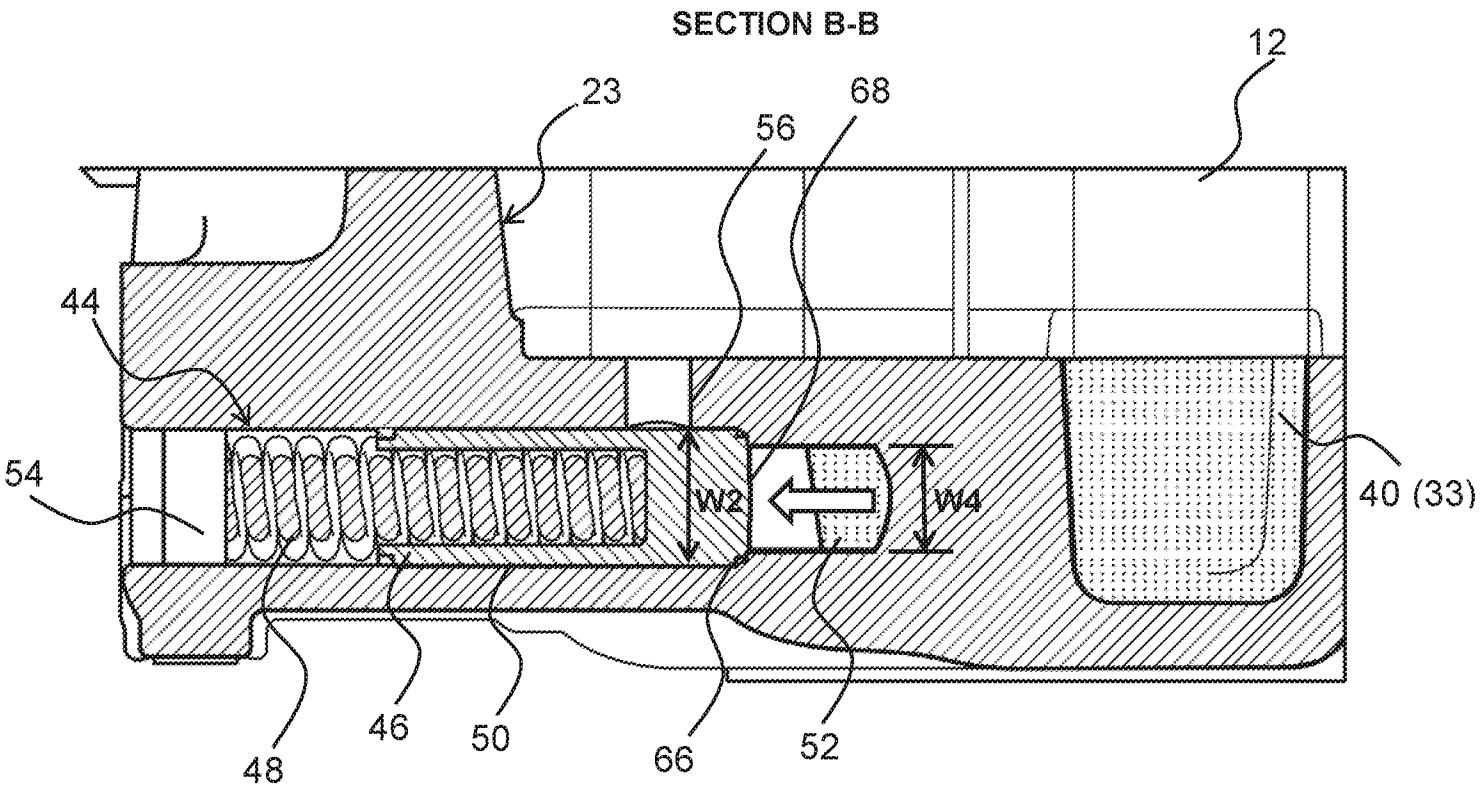
FIG. 6 is a cross sectional view taken along line B-B in FIG. 1, showing the relief valve in its closed position in accordance with an embodiment.
Figure 8:
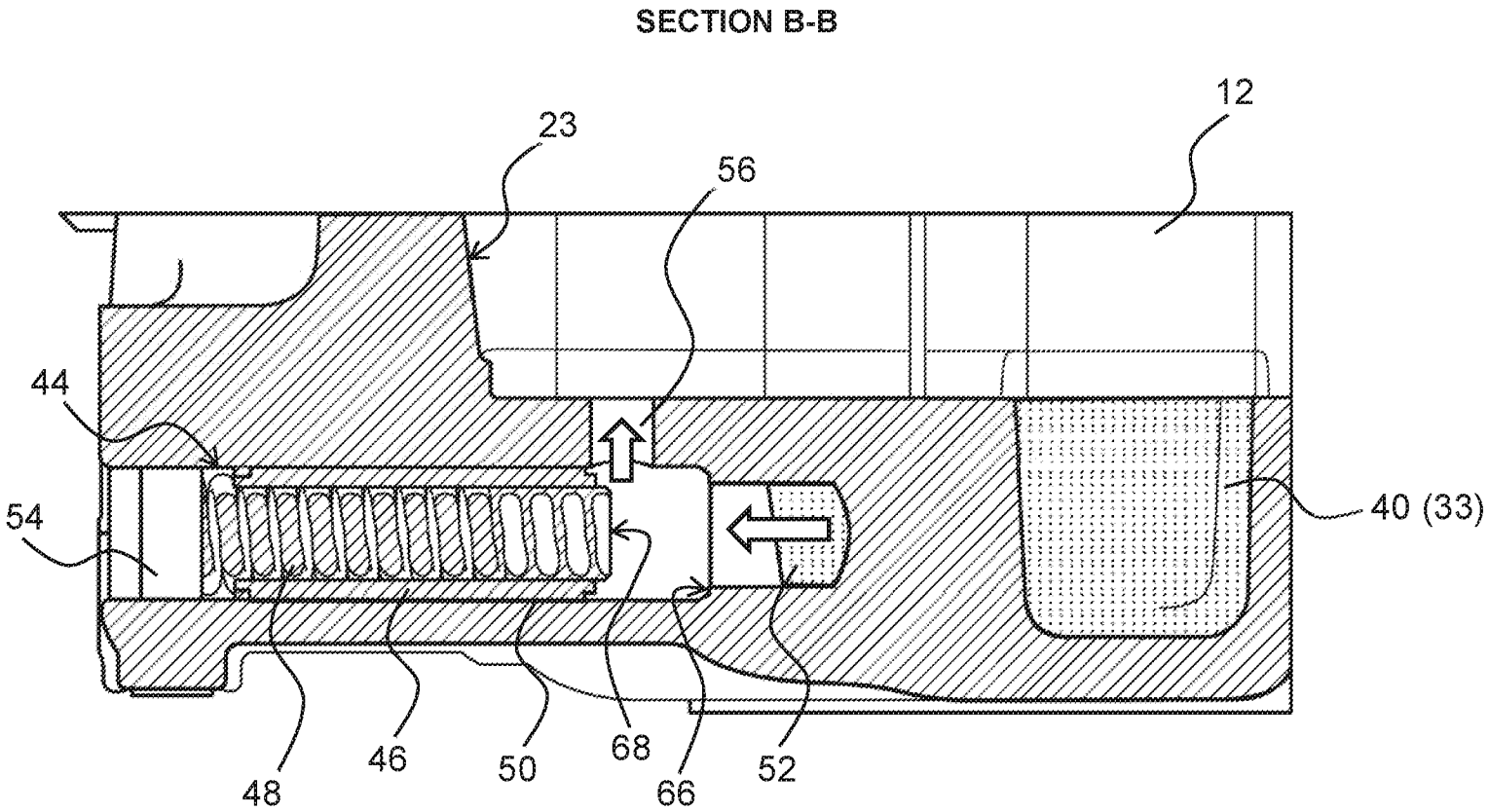
FIG. 8 is a cross-sectional view taken along line B-B in FIG. 1, showing the relief valve in an open position in accordance with an embodiment.

Also included in the housing 20 is a relief port 56, shown in FIG. 6 and FIG. 8, for example. The relief port 56 selectively communicates fluid from the outlet path 49 (e.g., from outlet port 33) to the feedback control chamber 36, based upon a position of the pressure-controlled relief valve 44. In an embodiment, the relief port 56 is positioned between and connects valve space 50 and feedback control chamber 36. In some embodiments, the relief port 56 may be provided below the control slide 12 in the housing 20.

The relief valve 44 may be activated to move towards or into the second valve position to control the pressure on the feedback control chamber 36 during any condition or setting of the electrical valve 70. That is, the main/electrical valve 70 is configured to control pressure in the control chamber 36 independently of the position of the relief valve 44, including delivering pressurized lubricant to pressurize the control chamber 36 to displace the control slide 12 in the displacement decreasing direction and venting pressurized lubricant from the control chamber to permit displacement of the control slide in the displacement increasing direction. This is because the electrical valve 70 and relief valve 44 are not fluidly connected. While electrical valve 70 is switched between feeding and venting states using an external controller, the relief valve 44 is controlled via pressure build up in outlet volume 52 and outlet path 49. The relief valve 44 does not block any control from the electrical valve 70 of the pump 10. Rather, the relief valve 44 simply acts as a relief or fail safe when pressure in the outlet volume exceeds a predetermined value or threshold.

Figure 7:
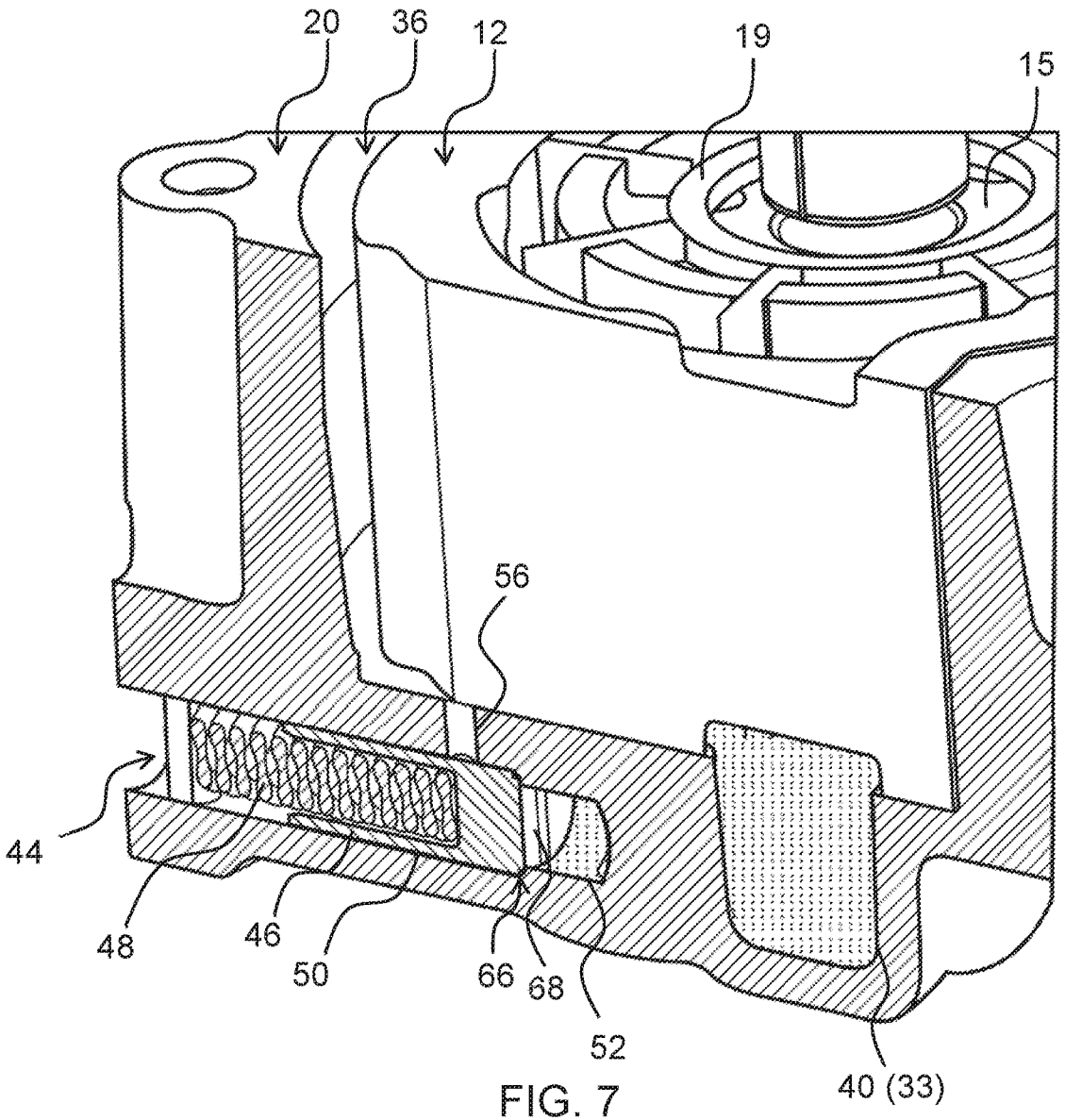
FIG. 7 is an angled perspective view of the cross-section of FIG. 6.

In operation, in its first valve position (or closed or default position) such as shown in FIGS. 6-7, the relief valve 44 is inactive and blocks fluid communication from the outlet path 49/outlet port 33 to the control chamber 36 through the relief port 56. The spool body 46 is pushed and biased by spring 48 (towards the right as shown in FIG. 6) such that its front/activation surface 68 is in contact with wall abutment 66 and its body 46 closes off relief port 56, thus limiting any flow from the supply control volume 52 to relief port 56. Accordingly, the feedback function is disabled. Fluid communication is provided through the outlet path 49 to outlet 40, during regular operation of the pump. Independently, the main control valve 70 may be used during this normal operation to control the pressure in the pump, i.e., to thus control a position of the slide 12 and/or pressurize control chamber 36.

Figure 9:
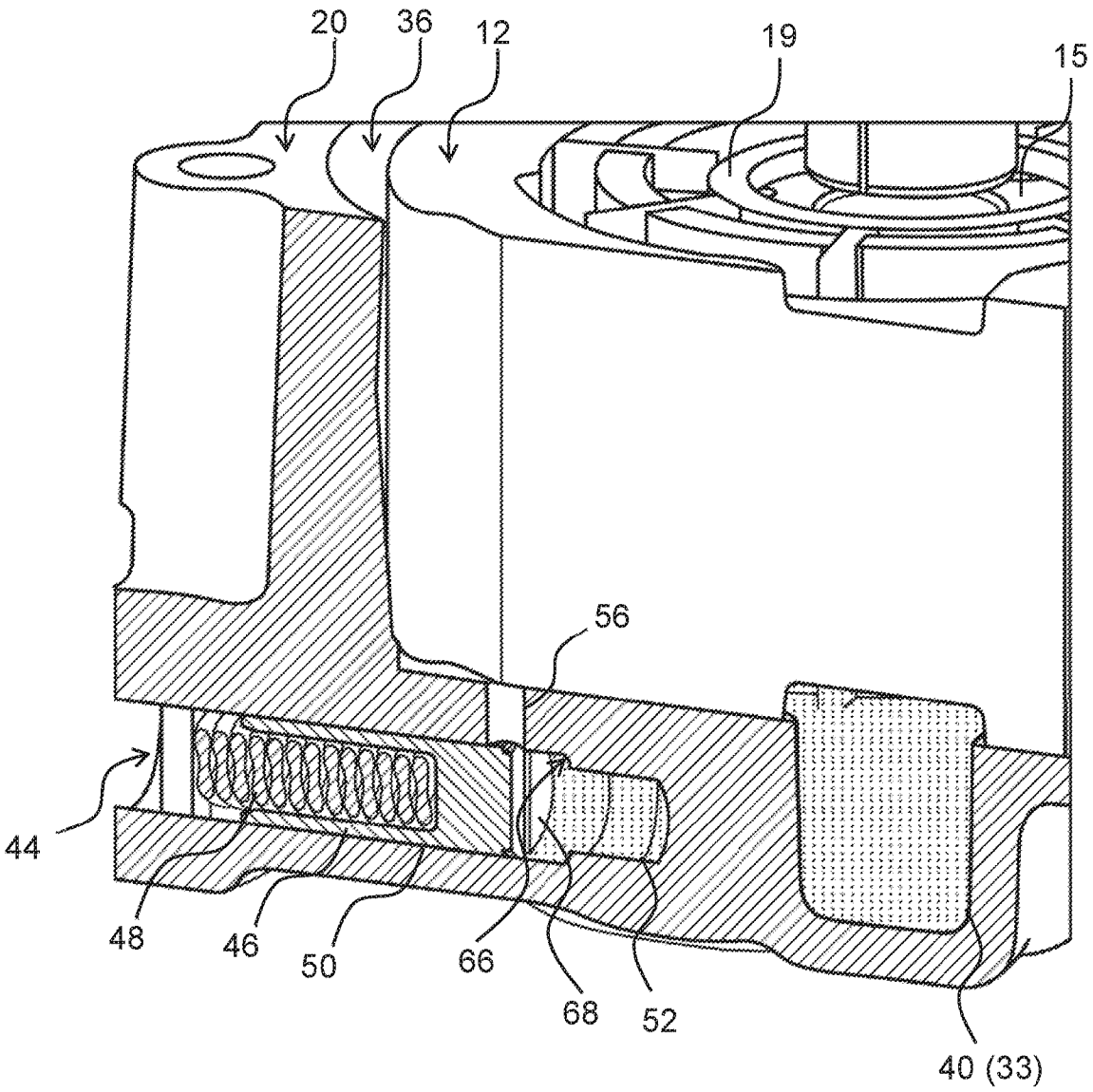
FIG. 9 is an angled perspective view of the cross-section of FIG. 8.

As pressure builds up in the supply control volume 52, the pressurized lubricant pushes against the activation surface 68 of body 46, as indicated by the arrow in FIG. 6. Once the outlet pressure of the lubricant within the supply control volume 52 exceeds a predetermined or threshold amount, the outlet pressure may act on the activation surface 68 of the relief valve 44 and moves it towards and/or to a second valve position (or open position or active position), such as shown in FIGS. 8-9. In this second valve position, as shown in FIG. 8, the body 46 and at least a portion of the front/activation surface 68 may move past the relief port 56 (towards the left as shown in FIG. 8), thereby opening at least a portion of the relief port 56 for fluid flow from the supply control volume 52 and through the relief port 56 to the control chamber 36. Accordingly, in a second valve position, the relief valve 44 permits fluid communication of the lubricant from the outlet path to the control chamber 36 through the relief port 56, thereby pressurizing the control chamber 36 and displacing the control slide 12 in the displacement decreasing direction independently from the main control valve. That is, the relief valve is active via its allowing fluid flow to the control chamber 36 from the outlet path. The additional lubricant in the feedback control chamber 36, in turn, causes an eccentricity of the control slide 12 to reduce.

Once displacement is decreased, pressure in the outlet path and supply control volume 52 also reduces. Accordingly, the spring 48 may be configured to move the body 46 of the valve 44 back to its first valve position, blocking the relief port 56.

The predetermined or threshold amount of pressure for activating the relief valve 44 may be based on a customer's specifications, for example. In an embodiment, the valve opening pressure (i.e., the pressure for activating the pressure-controlled relief valve 44 and hydraulically moving it to its second position) is approximately 6 bar. For example, when the pressure through supply control volume 52 directed to the valve body 46 is less than 6 bar (or any predetermined or threshold amount), the valve 44 remains in its first valve position as shown in FIGS. 6-7. However, when the pressure is at or exceeds ~6 bar (or the predetermined, threshold, or selected amount), the valve 44 may be hydraulically/mechanically moved to its second valve position, e.g., so that the lubricant flows through the relief port 56.

The dimensions of the relief valve 44 and its parts are not intended to be limiting. In an embodiment, the body 46 of the relief valve 44 has a width W2 that is less than a width W of the valve space 50, such that the body 46 may move relative to and within the space 50. Further, a width W4 of the supply control volume 52 may be less than the width of the body W2 such that wall abutment 66 is provided for contact with at least an edge of the front surface/activation surface 68 of the body 46. A width of the spring 48 and/or its coils are less than a width W3 of the receiving opening 47, in accordance with an embodiment.

Also provided in the pump 10, in accordance with an embodiment, may be a ball valve, which is shown in FIGS. 1 and 2. The cover 21 may be designed such that it has channels/openings to connect the outlet 49 to this ball valve. Generally, use of this type of ball valve is known in such pumps. In some cases, the ball valve may be unable to deal with displacement pressure (e.g., at 6.5 bar or more). However, in the disclosed configuration, in the event that the high pressure relief valve 44 becomes stuck or ineffective, the pump assembly 10 has this ball valve as a backup pressure activated ball relief valve to relieve pressure in outlet passage 49.

Accordingly, the pressure-controlled relief valve 44 as disclosed herein is a proportionally controlled valve that controls the pressure in the control chamber 36 without use of the electrical valve 70. The relief valve 44 is a separate and distinct relief feature and does not rely on PWM controlled feed to/from the control chamber. The relief valve 44 is a hydraulically operated valve that results in a mechanically-designed method of using pressure build up in an outlet volume to move a spool valve such that lubricant/fluid is fed into a feedback chamber of the pump. The relief valve 44 provides a fail-safe function that operates solely based on pressure (i.e., not using another control valve). Further, the design and location of this relief valve 44 does not block the vent/feedback channel 38 or any channel back to the electrical valve 70, other than the relief port 56 to the control chamber itself. Instead, the feedback channel 38 to the electrical valve 70 is always open and designed with a restrictive cross section.

The relief valve 44 may provide protection from high pressures during initial start-up of the pump 10 (i.e., during cold start of the pump, or system, and/or during other operations wherein the fluid (or lubricant or oil) is at colder or lower temperatures). The feedback channel 38 is configured to be less restrictive than the channels through the control valve 70 to allow the valve to maintain authority over the control slide 12 when the system is in normal operation mode. However, the system/pump will generally experience a time delay in regulating the control slide 12 with the control valve 70, e.g., when the [oil] passages are filling up with fluid/lubricant/oil when the engine first starts, and when the fluid/lubricant/oil is too cold to flow enough volume to sufficiently displace the control slide 12. When there is such a time delay, the pressure builds up in the outlet passage, thereby opening the relief valve 44 (i.e., the built up pressure moves the relief valve 44 from a closed or default first valve position to an open, second valve position). That is, with cold oil/lubricant (e.g., at cold start of the pump), that means the pressure will build up in the control chamber 36 slowly (since cold viscous lubricant travels more slowly). When lubricant is cold, movement through passages—including feedback channel 38, ports 42, 45—is restricted, yet allowed, for a period of time. The fluid/lubricant/oil from the relief valve directly feeds into control chamber 36 and may flow through channel 38 towards the control valve 70. After some time, outlet pressure also increases. However, due to the higher flow rate of fluid/lubricant/oil from valve 44 trying to pass through the more restrictive feedback channel 38, ports 45, 42, and back through valve 70, a pressure drop (or pressure differential) is created that acts on the control slide 12 to displace it to a lower displacement (i.e., displacement decreasing direction). This displacement of the slide 12 thus drops the outlet pressure and closes the relief valve 44. In some embodiments, once pressure builds in the outlet, and thus supply control volume 52, the spool body 46 may be moved and relief port 56 may be opened to feedback to the control chamber 36 to control the slide 12 while the lubricant is colder. Once the time delay is passed and pressure has reached the control valve, normal control operation of the pump 10 begins.

It should also be understood that this disclosure covers a method for reducing eccentricity of a variable vane pump, like the pump 10 as described herein via providing such features including the main control valve 70, the feedback channel 38 and the relief valve 44 in the pump 10, and providing a controller for controlling the pump 10 and its features. The method includes: hydraulically moving the pressure-controlled relief valve 44 from the first valve position to the second valve position based on the predetermined pressure of the lubricant acting on the activation surface; and permitting fluid communication of the lubricant from the outlet path to the control chamber 36 through the relief port, thereby pressurizing the control chamber 36 and displacing the control slide 12 in the displacement decreasing direction independently from the main control valve 70. The main control valve 70 is configured to control pressure in the control chamber 36 independently of the position of the relief valve 44, including delivering pressurized lubricant to pressurize the control chamber 36 to displace the control slide 12 in the displacement decreasing direction and venting pressurized lubricant from the control chamber to permit displacement of the control slide 12 in the displacement increasing direction.

While the drawings and description refer to using the main control valve and pressure-controlled relief valve with a vane pump, the herein disclosed valve systems can be used with different pump applications as well.

Figure 10:
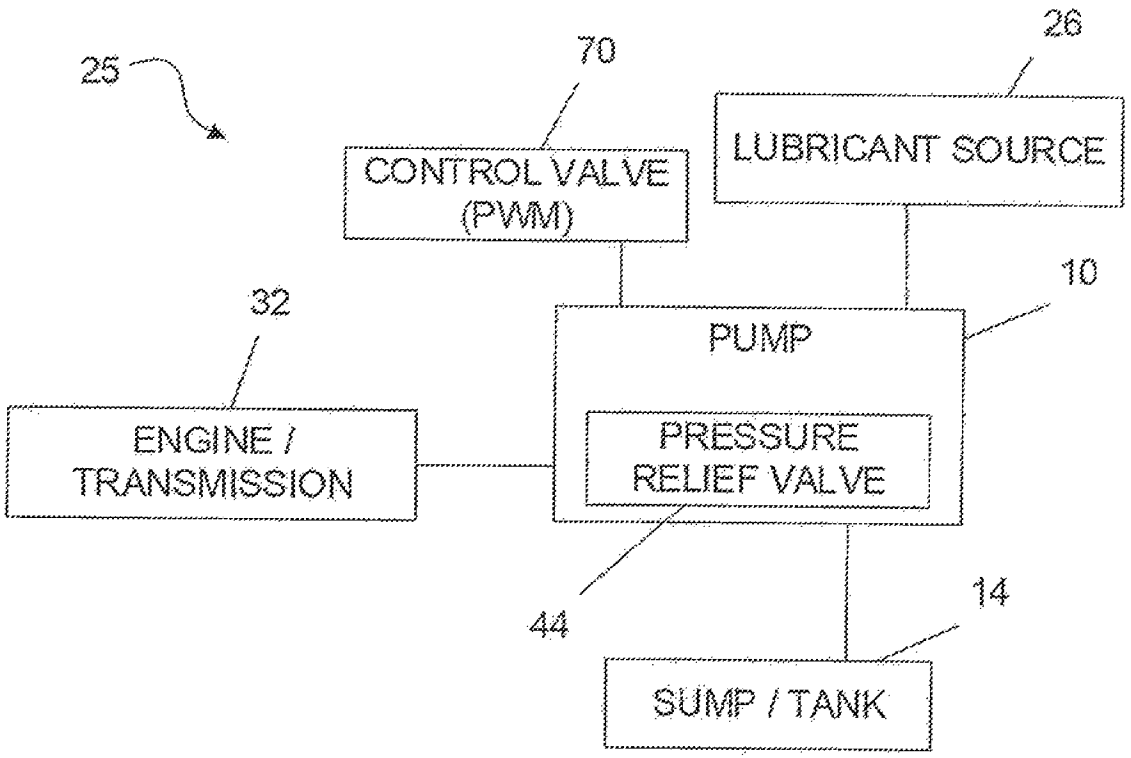
FIG. 10 is a schematic diagram of a system in accordance with an embodiment of the present disclosure.

FIG. 10 is a schematic diagram of a system 25 in accordance with an embodiment of the present disclosure. The system 25 can be a vehicle or part of a vehicle, for example. The system 25 includes a mechanical system such as an engine 32 (e.g., internal combustion engine) for receiving pressurized lubricant from the pump 10, and a sump or tank 14. The pump 10 receives lubricant (e.g., oil)

from a lubricant source 26 (input via inlet 30) and pressurizes and delivers it to the engine 32 (output via outlet 40). The pump 10 includes the main control valve 70 at least operatively connected thereto and the pressure-controlled relief valve 44 contained in its housing 20. As described in detail previously, the pressure-controlled relief valve 44 in the pump 10 is configured for selective movement to its second valve position when the outlet pressure is at or above the predetermined/threshold level, to feed lubricant from the outlet path/outlet port to back to the control chamber 36 through relief port 56.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A variable displacement vane pump for dispensing lubricant to a system, the pump comprising:

a housing comprising an inner surface defining an internal chamber;

an inlet for inputting the lubricant into the housing for pressurization, the inlet being connected to an inlet path in the housing;

an outlet for delivering pressurized lubricant to the system from the housing, the outlet being connected to an outlet path provided in the housing;

a control slide displaceable about a pivot pin within the internal chamber of the housing in (a) a displacement increasing direction for increasing pump displacement and (b) a displacement decreasing direction for reducing pump displacement, and the control slide having an inner surface defining a rotor receiving space;

a rotor with at least one vane mounted in the rotor receiving space of the control slide and configured for rotation within and relative to the control slide about a rotational axis for pressurizing the lubricant input via the inlet path, the at least one vane configured for engagement within the inner surface of the control slide during the rotation thereof;

the inlet and outlet being disposed on opposed radial sides of the rotational axis of the rotor, the inlet being provided on a first radial side and the outlet being provided on a second radial side that is opposite the first radial side;

a resilient structure biasing the control slide in the displacement increasing direction, the resilient structure being provided on the first radial side of the rotor and the pivot pin being provided on the second radial side of the rotor;

a control chamber for receiving the pressurized lubricant provided between the housing and the control slide that is configured and arranged to move the control slide in the displacement decreasing direction, the control chamber extending into both the first and second radial sides of the rotor;

a relief port provided in the housing for selectively communicating the lubricant from the outlet path to the control chamber;

a feedback channel provided in the housing and fluidly connecting to a control port that is connected to a main control valve which is configured to control pressure in the control chamber including using the feedback channel for delivering or venting the lubricant to or from the control chamber under control of the main control valve;

a pressure-controlled relief valve positioned in the housing, the relief valve having an activation surface being in fluid communication with the outlet path and being moveable from a first valve position to a second valve position based on a predetermined pressure of the lubricant acting on the activation surface, the relief valve being fluidly disconnected from the main control valve and the feedback channel such that the venting of the control chamber is based on a position of the main control valve;

wherein the main control valve is configured to control pressure in the control chamber independently of the position of the relief valve, including delivering the pressurized lubricant to pressurize the control chamber to displace the control slide in the displacement decreasing direction and venting the pressurized lubricant from the control chamber via the feedback channel to permit displacement of the control slide in the displacement increasing direction;

wherein, in its first valve position, the relief valve is inactive and blocks the fluid communication from the outlet path to the control chamber through the relief port, and wherein, in its second valve position, the relief valve permits the fluid communication of the lubricant from the outlet path to the control chamber through the relief port, thereby pressurizing the control chamber and displacing the control slide in the displacement decreasing direction independently from the main control valve.

2. The pump according to claim 1, wherein when the relief valve is in the second valve position, the feedback channel is configured to restrict fluid flow of lubricant therethrough for a period of time such that pressure builds in the control chamber until a pressure differential is formed to displace the control slide to the displacement decreasing direction.

3. The pump according to claim 1, wherein the pressure-controlled relief valve is positioned in the housing on the second radial side of the rotor.

4. The pump according to claim 1, wherein the inlet path is provided adjacent to the resilient structure and the outlet path is provided adjacent to the pivot pin.

5. The pump according to claim 1, wherein the pressure-controlled relief valve positioned in the housing adjacent to the pivot pin.

6. The pump according to claim 1, further comprising a supply control volume in the housing, the supply control volume connecting the outlet path to the pressure-controlled relief valve and configured to receive the pressurized lubricant therein, wherein pressure of the lubricant is configured to build in the supply control volume such that upon reaching and/or exceeding the predetermined output pressure, the relief valve is moved to its second valve position.

7. The pump according to claim 6, wherein the pressure-controlled relief valve comprises a body and a spring, and wherein, in the second valve position, the spring is configured to be compressed via movement of the body as a result of the lubricant from the outlet path being fed through the supply control volume and applying force to move the body of the pressure-controlled relief valve.

8. The pump according to claim 1, wherein the relief port is provided below the control slide in the housing.

9. The pump according to claim 1, wherein the feedback channel is positioned adjacent to the resilient structure.

10. The pump according to claim 1, wherein the feedback channel is positioned adjacent the inlet.

11. The pump according to claim 1, wherein the feedback channel is provided between the housing and a cover.

12. The pump according to claim 11, wherein the feedback channel is formed in a wall that defines the internal chamber of the housing.

13. The pump according to claim 1, wherein the system is an engine.

14. A system comprising:

an engine;

a lubricant sump containing lubricant; and the variable displacement vane pump of claim 1 for dispensing the lubricant to the engine.

15. A method for reducing eccentricity of the variable vane pump according to claim 1; the method comprising:

hydraulically moving the pressure-controlled relief valve from the first valve position to the second valve position based on the predetermined pressure of the lubricant acting on the activation surface; and permitting the fluid communication of the lubricant from the outlet path to the control chamber through the relief port, thereby pressurizing the control chamber and displacing the control slide in the displacement decreasing direction independently from the main control valve, wherein the main control valve is configured to control pressure in the control chamber independently of the position of the relief valve, including delivering the pressurized lubricant to pressurize the control chamber to displace the control slide in the displacement decreasing direction and venting the pressurized lubricant from the control chamber to permit displacement of the control slide in the displacement increasing direction.

16. The method according to claim 15, wherein, during the permitting the fluid communication of the lubricant from the outlet path to the control chamber through the relief port when the relief valve is in the second valve position, and wherein when the lubricant is cold, the feedback channel is configured to restrict fluid flow of lubricant therethrough for a period of time such that the pressure builds in the control chamber until a pressure differential is formed to displace the control slide to the displacement decreasing direction.

17. The pump according to claim 1, wherein the feedback channel is always open and designed with a restrictive cross-section to restrict flow of cold lubricant from the control chamber while the relief valve is in the second position which permits the fluid communication of the lubricant from the outlet path to the control chamber through the relief port.

18. The method according to claim 15, wherein the feedback channel is always open, and wherein while the relief valve is in the second position to permit the fluid communication of the lubricant from the outlet path to the control chamber through the relief port, the feedback channel restricts flow of cold lubricant from the control chamber.

* * * * *